US008210896B2

(12) United States Patent
Wittenberg

(10) Patent No.: US 8,210,896 B2
(45) Date of Patent: Jul. 3, 2012

(54) LIGHT AND SOUND MECHANISMS FOR TOYS

(75) Inventor: Mark S. Wittenberg, Rossmoor, CA (US)

(73) Assignee: Mattel, Inc., El Segundo, CA (US)

( * ) Notice: Subject to any disclaimer, the term of this patent is extended or adjusted under 35 U.S.C. 154(b) by 262 days.

(21) Appl. No.: 12/427,661

(22) Filed: Apr. 21, 2009

(65) Prior Publication Data

US 2009/0264043 A1 Oct. 22, 2009

Related U.S. Application Data

(60) Provisional application No. 61/125,083, filed on Apr. 21, 2008.

(51) Int. Cl.
*A63H 3/28* (2006.01)

(52) U.S. Cl. ..... 446/297; 446/72; 446/73; 446/268; 446/330; 446/376; 434/393

(58) Field of Classification Search ..... 446/73, 446/268, 297, 330, 376, 72; 434/393
See application file for complete search history.

(56) References Cited

U.S. PATENT DOCUMENTS

| | | | |
|---|---|---|---|
| 2,313,378 | A | 3/1943 | Wolf |
| 2,459,100 | A | 1/1949 | Treuting |
| 2,704,908 | A | 3/1955 | Lamkin |
| 2,704,909 | A | 3/1955 | Lamkin |
| 3,626,555 | A | 12/1971 | Albertini |
| 3,630,520 | A | 12/1971 | Cooper |
| 3,740,543 | A | 6/1973 | Franc |
| 3,787,998 | A | 1/1974 | Kilroy et al. |
| 4,109,411 | A | 8/1978 | Wetherell et al. |
| 4,121,373 | A | 10/1978 | Slowe et al. |
| 4,186,425 | A | 1/1980 | Nadimi |
| 4,186,515 | A | 2/1980 | Ogawa |
| 4,245,425 | A | 1/1981 | D'Andrade |
| 4,307,533 | A | 12/1981 | Sims et al. |
| D282,452 | S | 2/1986 | Insetta |
| 4,571,206 | A | 2/1986 | Mayer et al. |
| 4,575,349 | A | 3/1986 | Piazza et al. |
| 4,585,424 | A | 4/1986 | DeMars |
| 4,610,639 | A | 9/1986 | Piazza |
| 4,729,748 | A | 3/1988 | Van |
| 4,867,729 | A | 9/1989 | Weinman et al. |

(Continued)

FOREIGN PATENT DOCUMENTS

| | | |
|---|---|---|
| JP | 09051989 | 2/1997 |

(Continued)

OTHER PUBLICATIONS

2002 Mattel Catalog, Penelope Dragon, p. 5.

(Continued)

*Primary Examiner* — Alvin Hunter
*Assistant Examiner* — Alexander Niconovich
(74) *Attorney, Agent, or Firm* — Kolisch Hartwell, PC

(57) ABSTRACT

A lights and sounds mechanism for use in a toy is provided. The lights and sounds mechanism may be connected to a product test switch switch. One or more components of the toy may be disassembled for packaging. The disassembled components may include one or more lights or speakers. When the product test switch is triggered, the lights and/or speakers in the disassembled components may properly function.

20 Claims, 2 Drawing Sheets

U.S. PATENT DOCUMENTS 4,869,701 A * 9/1989 Kawai et al. ..... 446/91
4,925,025 A * 5/1990 Anten et al. ..... 206/335
4,988,320 A 1/1991 Rankin et al.
5,042,972 A * 8/1991 Bach et al. ..... 446/91
5,052,969 A 10/1991 Smith
5,061,217 A * 10/1991 Miller et al. ..... 446/61
5,073,137 A 12/1991 Miller et al.
5,074,820 A * 12/1991 Nakayama ..... 446/29
5,114,376 A 5/1992 Copley
5,118,319 A 6/1992 Smith et al.
5,163,861 A 11/1992 Van
5,172,806 A * 12/1992 Mickelberg ..... 206/756
5,188,222 A 2/1993 Pierce
5,211,282 A 5/1993 Ting
5,267,886 A * 12/1993 Wood et al. ..... 446/175
5,277,644 A 1/1994 Osborne et al.
5,288,259 A 2/1994 Konta et al.
5,289,916 A * 3/1994 Mickelberg ..... 206/756
5,314,336 A * 5/1994 Diamond et al. ..... 434/169
5,316,515 A 5/1994 Hyman et al.
5,378,188 A 1/1995 Clark
5,672,090 A 9/1997 Liu
5,730,638 A * 3/1998 Ward ..... 446/297
5,791,965 A * 8/1998 Kim ..... 446/219
5,803,787 A 9/1998 Kulchyski
5,919,074 A * 7/1999 Honda ..... 446/268
5,964,638 A 10/1999 Emerson
6,011,489 A * 1/2000 Ki Kwan et al. ..... 340/12.3
6,012,962 A 1/2000 Arriola
6,152,799 A 11/2000 Arriola
6,165,037 A * 12/2000 Van Zant ..... 446/219
6,190,229 B1 2/2001 Nadel et al.
6,257,948 B1 * 7/2001 Silva ..... 446/100
6,524,156 B1 2/2003 Horchler et al.
6,537,130 B1 3/2003 Lee et al.
6,572,428 B1 6/2003 Weiser et al.
6,599,160 B2 7/2003 Weiser et al.
6,632,119 B2 10/2003 Chernek et al.
6,679,751 B1 * 1/2004 Maxwell et al. ..... 446/91
6,682,390 B2 1/2004 Saito
6,699,098 B1 3/2004 Kau
6,727,826 B1 * 4/2004 Ki Kwan et al. ..... 340/12.3
6,749,437 B2 * 6/2004 Chan ..... 434/393
6,780,076 B2 8/2004 Horchler et al.
6,881,118 B2 4/2005 Klick
6,899,589 B1 5/2005 Lund et al.
6,962,518 B2 11/2005 Wang
7,037,163 B2 5/2006 Beard
7,094,981 B2 * 8/2006 Sorrentino et al. ..... 200/332.2
7,175,496 B1 2/2007 Lund et al.
7,264,534 B2 9/2007 Stubenfoll
7,641,052 B2 * 1/2010 Calendrille, Jr. ..... 206/779
7,954,641 B2 * 6/2011 Calendrille et al. ..... 206/779
2002/0106624 A1 8/2002 Chan
2004/0093653 A1 5/2004 Beard
2005/0191396 A1 9/2005 Seltzer
2005/0284788 A1 12/2005 Elliott
2006/0270307 A1 11/2006 Montalvo

FOREIGN PATENT DOCUMENTS

JP 2006087908 4/2006

OTHER PUBLICATIONS

International Search Report and Written Opinion for related Application No. PCT/US2009/041308, dated Jun. 25, 2009.
US Receiving Office, International Preliminary Report on Patentability for related Application No. PCT/US2009/041308, Nov. 4, 2010, 6 pages.
Instituto Mexicano De La Propiedad Industrial, Official Action for related Application No. MX/u12010/000456, Jan. 20, 2012, 2 pages.
Intellectual Property Office, Examination Report for related Application No. GB1019451.2, Mar. 29, 2012, 2 pages.

* cited by examiner

LIGHT AND SOUND MECHANISMS FOR TOYS

CROSS REFERENCE TO RELATED APPLICATION

This application claims priority under 35 U.S.C. §119(e) to U.S. Provisional Patent Application No. 61/125,083 entitled "Lights and Sounds Mechanism for Toys", filed Apr. 21, 2008, the disclosure of which is herein incorporated by reference in their entirety for all purposes.

BACKGROUND OF THE DISCLOSURE

The present disclosure relates to light and sound mechanisms for toys, and specifically to light and sound mechanisms including a product test switch that remains operative when components of the toy are disassembled for packaging. Toys including lights and sounds mechanisms permit a toy to emit light and/or produce sound when a switch is triggered. Packaged toys include a product test switch feature permit potential purchasers to push a button or similar mechanism to see the toy function while still in the packaging.

Examples of lights and sounds mechanisms and/or product test switch features used in toys may be found in the following patents and published patent applications: U.S. Pat. Nos. 2,313,378, 4,121,373, 4,186,515, 4,245,425, 4,307,533, 4,610,639, 4,869,701, 4,925,025, 5,052,969, 5,074,820, 5,114,376, 5,118,319, 5,172,806, 5,188,222, 5,267,886, 5,277,644, 5,289,916, 5,672,090, 5,730,638, 5,791,965, 5,803,787, 5,919,074, 6,011,489, 6,727,826, 6,749,437, 7,037,163, 7,175,496, US20020106624, and US20040093653. The disclosures of all the patent publications, patents, and other publications recited in this application are herein incorporated by reference in their entirety for all purposes.

SUMMARY OF THE DISCLOSURE

A lights and sounds mechanism with a product test switch for use in a toy is provided. The lights and sounds mechanism permits the toy to emit light and/or sound when a switch is triggered. Additionally, the lights and sounds mechanism may function while the disassembled components of the toy are still in packaging when the product test switch is engaged.

The advantages of the present invention will be understood more readily after consideration of the drawings and Detailed Description below.

DETAILED DESCRIPTION OF THE DISCLOSURE

Figure 1:
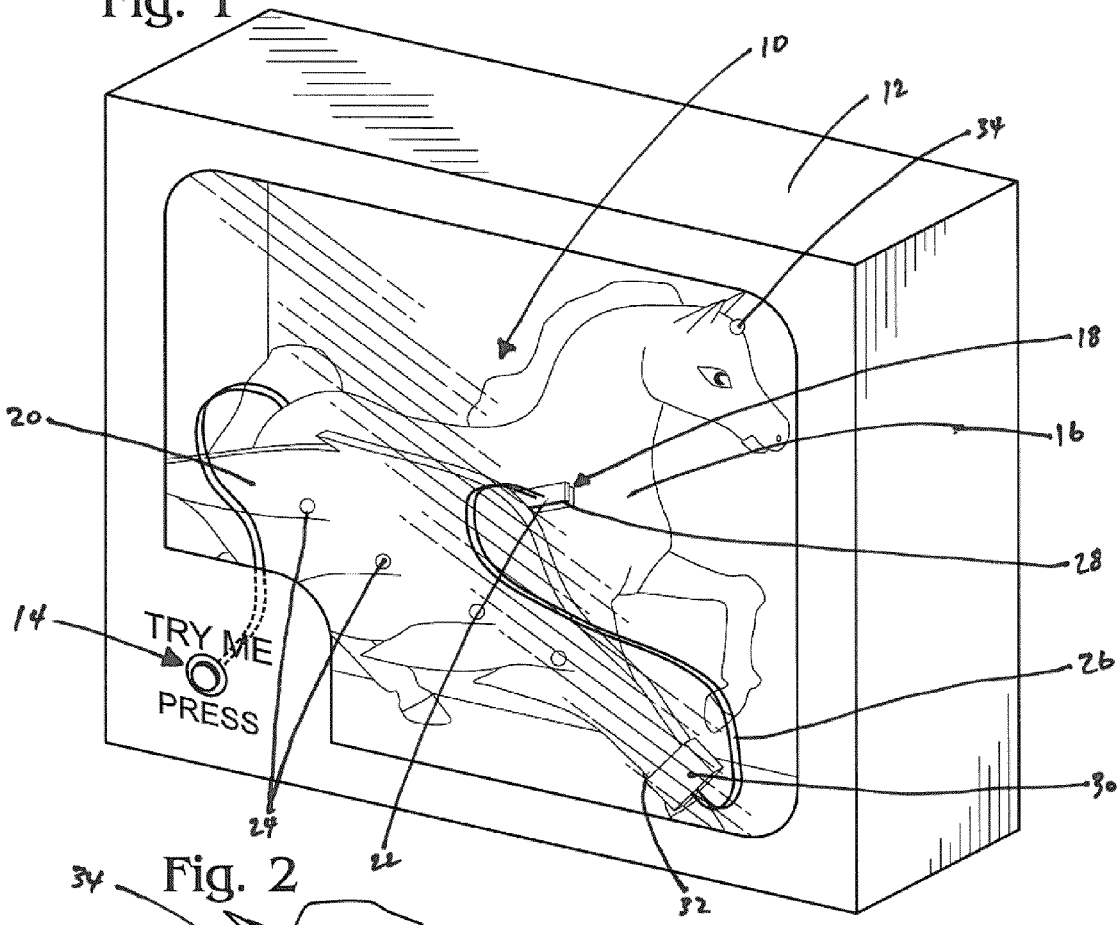
FIG. 1 shows a perspective view of a disassembled toy having a lights and sounds mechanism housed in packaging and including a product test switch wired from the exterior of the packaging to the toy.

FIG. 1 shows a perspective view of an example of a deconstructed toy horse 10 within packaging 12 containing a lights and sounds mechanism in accordance with the present disclosure. The lights and sounds mechanism—or audiovisual mechanism—may include one or more switches, lights, and/or speakers. Switches may be implemented in toy such that light may be emitted and/or sound may be produced when the switches are triggered. Toy horse 10 also may include a product test switch 14 or switch on the toy packaging 12. The lights and sounds mechanism may remain operable when components of a toy are deconstructed for packaging.

In the embodiment shown in FIG. 1, toy horse 10 may include a body 16, one or more body connectors 18 formed in body 16, and detachable wings 20. Wings may connect to connect to body 16 via one or more body connectors 18. An example of a body connector 18 is a one-time, snap fit connection. Body connector 18 may also provide an electric connection 22 with the lights and sounds mechanism stored within body 16.

Wings may include one or more lights 24 and may be physically and electronically connected to body 16 via body connector 18. In one embodiment, a male or female electric connection may be included inside body connector 18 and connected to the lights and sounds mechanism housed within body 16. In such an embodiment, wings 20 may include a reciprocal electric connection 22 such that when wings 20 are connected to body connector 18 the male and female components of the electric connection 22 are engaged, thereby connecting wings 20 to lights and sounds mechanism.

Wings 20 may be removed from body 16 of toy horse 10 for packaging so that a smaller, more compact package may be used. Electric connection 22 may include electric wiring 26 having first and second end couplers 28, 30. First end coupler 28 may be configured to be attached to body connector 18. Second end coupler 30 may be configured to be attached to a component connector 32.

In an alternative embodiment, body connector 18 may define an aperture such that wiring may thread through the aperture to the lights and sounds mechanism. The wiring may run from wings 20 through aperture to directly connect to the lights and sounds mechanism stored within body 16. Wings 20 may be removed from body connector 18 for packaging, but a sufficient amount of wiring may be provided such that wings 20 remain electronically connected while stored in packaging 12.

The lights and sounds mechanism may be stored within body 16 of toy horse 10 and may include one or more of a power source, switches, lights 34, and speakers. When the one or more switches are triggered, toy horse 10 may emit light and/or produce sound. For example, a switch may be provided adjacent the mane or tail of toy horse. When a user pulls on the mane or tail, the switch may be triggered causing the lights and sounds mechanism to emit light and/or produce sound.

As shown in FIG. 1, packaging 12 for toy horse 10 may also include a product test switch 14. Product test switch 14 may be an auxiliary switch. In such an embodiment, product test switch 14 may be wired from the exterior of packaging 12 to the lights and sounds mechanism housed within body 16. When the switch is triggered, the lights and sounds mechanism may emit light and/or produce sound.

Additionally, when product test switch 14 is triggered, lights and or speakers housed within wings 20 may emit light and/or produce sound. The audiovisual components stored within wings 20 remain operable because they remain connected to the lights and sounds mechanism. The components also remain operable even when disassembled for packaging because external wiring 26 including first and second end couplers 28, 30 may attach wings 20 to lights and sounds mechanism.

In an alternative embodiment, product test switch 14 may be located directly on body 16 of toy horse 10. In such an example, an aperture may be formed in packaging 12 such that a potential customer is able to reach inside packaging 12 to engage product test switch 14. Whether located on body 16 of toy horse 16 or as an auxiliary switch, product test switch 14 may cause lights and sounds mechanism to emit light and/or produce sound while toy is deconstructed for packaging.

Figure 2:
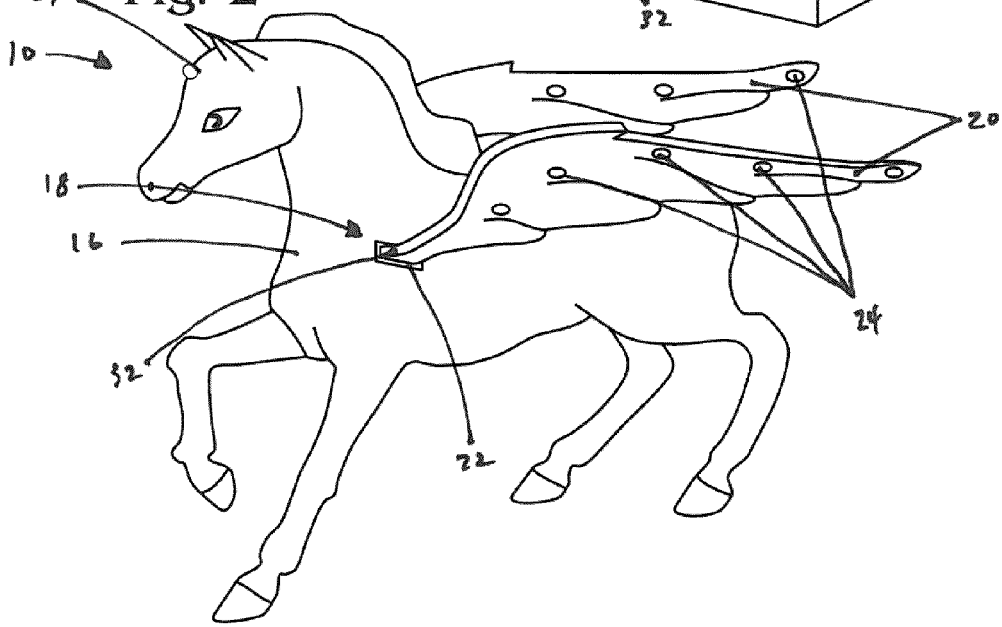
FIG. 2 shows a perspective view of the assembled toy shown in FIG. 1.

FIG. 2 shows a perspective view of fully assembled toy horse of FIG. 1. Wings 20 are connected to body 16 via body connector 18. In an embodiment utilizing an external wiring 26 including first and second end couplers 28, 30, external wiring 26 may be removed and disposed of so wings 20 may directly connect to body. Alternatively, if wings 20 are wired directly to the lights and sounds mechanism through an aperture in body connector 18, wiring may be fed through aperture and permanently stored inside body 16 of toy horse 10.

Figure 3:
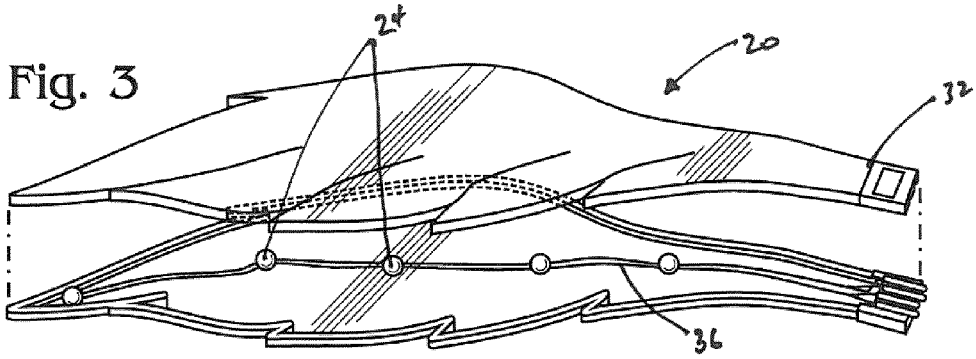
FIG. 3 shows an exploded view of a separable component of the toy shown in FIG. 1.

FIG. 3 shows a deconstructed wing 20 of toy horse shown in FIG. 1. As shown in FIG. 3, wing may include one or more lights 24, such as light-emitting diodes, connected by wiring 36. Wiring 36 may terminate at a component connector 32 at one end of wing 20. In such an embodiment, a reciprocal switch may be provided on the toy body 16 such that wing 20 may electronically connect to the lights and sounds mechanism stored therein. In packaging 12, an external wiring 26 electronically connect lights in wing to body. When the toy is removed from the packaging 12, the external wiring may be unplugged from wing 20 and body 16 to permit wing 20 to be directly connected to body connector 18.

Figure 4:
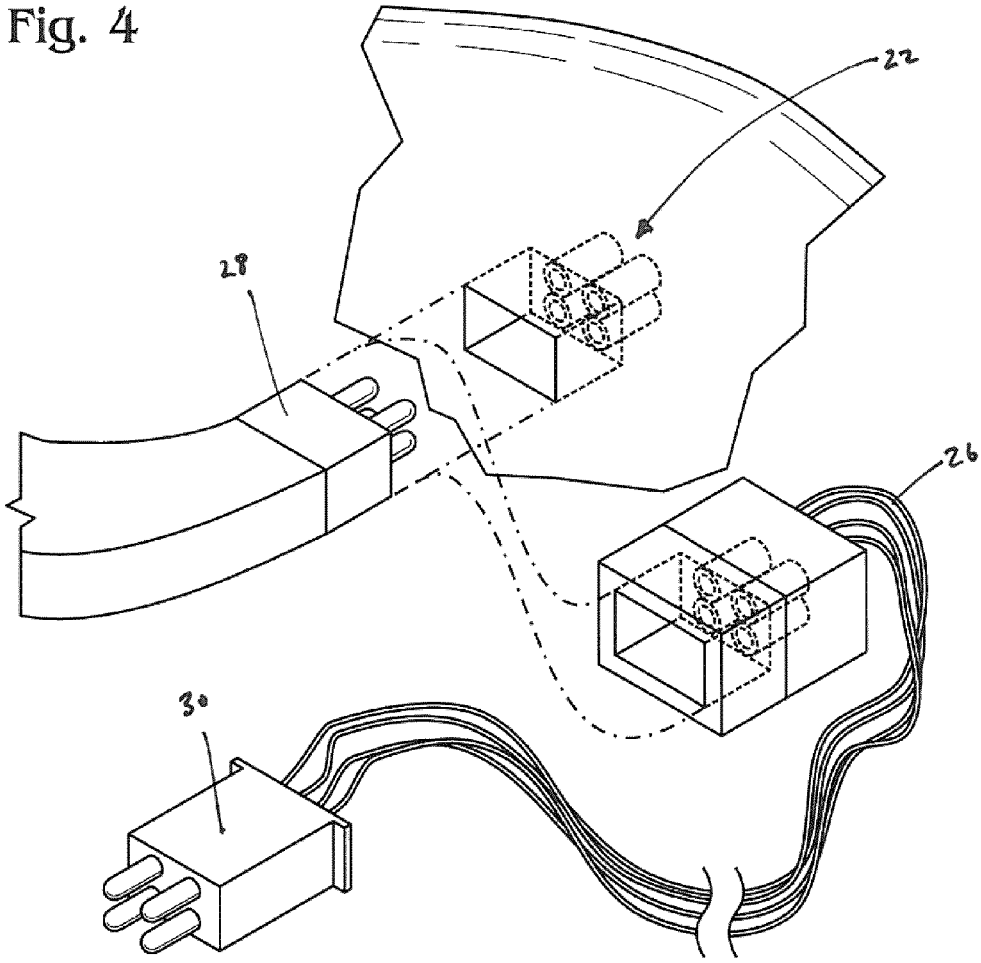
FIG. 4 shows a plan view of an external electronic connector.

FIG. 4 shows an example of external wiring 26 having first and second couplers 28, 30. In a toy horse 10 using such an external electronic connector, toy horse 10 and wing 20 may include complementary male and female connectors such that wing may be plugged into toy horse upon removal from packaging. While toy horse 10 is stored in packaging 12, external wiring 26 including couplers 28, 30 may connect to wing 20 at one end and body connector 18 on the other. In effect, external wiring 26 functions similar to a generally known extension cord. External wiring 26 therefore permits lights and/or speakers implemented in components disassembled for packaging to properly function.

Although particular structures are shown for the one or more wings, external wiring, and the body connector of the present disclosure, any suitable structure(s) may alternatively, or additionally, be used that are configured to electronically connect light and/or sound devices in the wing to the lights and sounds mechanism housed within body of toy horse. Additionally, the presently disclosed lights and sounds mechanism having a product test switch is described particularly with reference to a toy horse having detachable wings. However, this disclosure is not meant to be limited to such an embodiment. The scope of the present disclosure may encompass other toys or devices including components that may be detached for packaging that include a product test switch permitting operation of a mechanism—such as a light or speaker—housed within the detachable component.

While embodiments of a toy and toy play have been particularly shown and described, many variations may be made therein. This disclosure may include one or more independent or interdependent inventions directed to various combinations of features, functions, elements and/or properties, one or more of which may be defined in the following claims. Other combinations and sub-combinations of features, functions, elements and/or properties may be claimed later in a related application. Such variations, whether different, broader, narrower or equal in scope, are also regarded as included within the subject matter of the present disclosure. An appreciation of the availability or significance of the claims not presently claimed may not be presently realized. Accordingly, the foregoing embodiments are illustrative, and no single feature or element, or combination thereof, is essential to all possible combinations that may be claimed in this or a later application. Each claim defines an invention disclosed in the foregoing disclosure, but any one claim does not necessarily encompass all features and combinations that may be claimed. Where the claims recite "a" or "a first" element or the equivalent thereof, such claims include one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

What is claimed is:

1. A toy configured to be contained in packaging, comprising:

a body including at least one body connector;

an audiovisual mechanism housed within the body, the audiovisual mechanism including a power source and at least one of a switch, a light, and a speaker;

one or more toy components including at least one component connector, the component connector configured to be attached to the body connector, the one or more toy components including at least one of a component light and a component speaker, one of the body and component connectors including at least one protruding portion and the other of the body and component connectors including at least one receiving portion that is configured to receive the at least one protruding portion to attach the component connector to the body connector;

an electric connection configured to electrically connect the one or more toy components to the audiovisual mechanism when the one or more toy components are detached from the body; and a product test switch configured to actuate the audiovisual mechanism and the at least one of a component light and a component speaker, the product test switch including an actuator positioned to be accessible from external the packaging.

2. The toy of claim 1, wherein the electric connection includes electric wiring having first and second end couplers, the first end coupler being configured to be attached to the body connector, and the second end coupler being configured to be attached to the component connector.

3. The toy of claim 1 wherein the product test switch includes a coupler and electric wiring connecting the coupler and the actuator, the coupler configured to be attached to the body.

4. The toy of claim 1, wherein the packaging includes a plurality of walls forming an interior compartment sized to receive the toy and a wall of the plurality of walls includes an aperture, and the actuator is accessible through the aperture.

5. The toy of claim 1 wherein the at least one of a component light and a component speaker is electrically connected to the audiovisual mechanism when the component connector is attached to the at least one body connector.

6. The toy of claim 1 wherein the actuator is a button.

7. The toy of claim 2, wherein the body connector is one of complementary male and female connectors, and the first end coupler is the other of the complementary male and female connectors.

8. The toy of claim 2, wherein the component connector is one of complementary male and female connectors, and the second end coupler is the other of the complementary male and female connectors.

9. A packaged toy, comprising:

a toy, including:

a body including at least one body connector;

an audiovisual mechanism housed within the body, the audiovisual mechanism including a power source and at least one of a switch, a light, and a speaker;

one or more toy components including at least one component connector, the component connector configured to be selectively attached to, or detached from, the body connector, the one or more toy components including at least one of a component light and a component speaker;

an electric connection configured to electrically connect the one or more toy components to the audiovisual mechanism when the one or more toy components are detached from the body, wherein the component connector is configured to be attached to the body connector without the electric connection; and a product test switch configured to actuate the audiovisual mechanism and the at component light or component speaker, the product test switch including an actuator; and packaging including a plurality of walls forming an interior compartment sized to receive the toy, a wall of the plurality of walls including an aperture, wherein the actuator of the product test switch is positioned adjacent to the aperture such that the actuator is accessible from external the packaging, and wherein the electric connection includes electric wiring having first and second end couplers, the first end coupler being configured to be attached to the body connector, and the second end coupler being configured to be attached to the component connector.

10. The toy of claim 9 wherein the product test switch includes a coupler and electric wiring connecting the coupler and the actuator, the coupler configured to be attached to the body.

11. The toy of claim 9, wherein the packaging includes a plurality of walls forming an interior compartment sized to receive the toy and a wall of the plurality of walls includes an aperture, and the actuator is accessible through the aperture.

12. The toy of claim 9 wherein the at least one of a component light and a component speaker is electrically connected to the audiovisual mechanism when the component connector is attached to the at least one body connector.

13. The toy of claim 9 wherein the actuator is a button.

14. The toy of claim 9, wherein the body connector is one of complementary male and female connectors, and the component connector is the other of the complementary male and female connectors.

15. The toy of claim 14, wherein the first end coupler is a first connector complementary with the body connector, and the second end coupler is a second connector complementary with the component connector.

16. A toy configured to be contained in packaging, comprising:

a body having at least one body connector;

an audiovisual mechanism contained within the body and having at least one light and at least one speaker;

one or more toy components including at least one component connector complementary with the at least one body connector and configured to be selectively attached to, or detached from, the at least one body connector, the one or more toy components including at least one of a component light and a component speaker;

an electrical wiring assembly configured to electrically connect the one or more toy components to the audiovisual mechanism when the at least one component connector and the least one body connector are detached from each other, the electrical wiring assembly having first and second end couplers, the first end coupler being complementary with the at least one body connector and configured to be attached to the at least one body connector, and the second end coupler being complementary with the at least one component connector and configured to be attached to the at least one component connector, wherein the at least one component connector is configured to be attached to the at least one body connector when (1) the first end coupler is detached from the at least one body connector and (2) the second end coupler is detached from the at least one component connector; and a product test switch configured to actuate the audiovisual mechanism and the at least one of a component light and a component speaker, the product test switch including an actuator accessible from external the packaging.

17. The toy of claim 16, wherein the toy is a toy horse and the one or more toy components includes a toy wing.

18. The toy of claim 17, wherein a body of the toy horse includes at least one horse body connector, and the toy wing includes at least one wing connector complementary with the at least one horse body connector and configured to be attached to the at least one horse body connector.

19. The toy of claim 18, wherein the at least one horse body connector includes one of complementary male and female connectors, and the at least one wing connector includes the other of the complementary male and female connectors.

20. The toy of claim 19, wherein the first end coupler includes a connector complementary with the at least one horse body connector, and the second end coupler includes a connector complementary with the at least one wing connector.

* * * * *